US010857786B2

(12) United States Patent
Korthuis et al.

(10) Patent No.: US 10,857,786 B2
(45) Date of Patent: Dec. 8, 2020

(54) FLUID DRIVER ACTUATION CONTROL USING OFFSET

(71) Applicant: HEWLETT-PACKARD DEVELOPMENT COMPANY, L.P., Spring, TX (US)

(72) Inventors: Vincent C Korthuis, Corvallis, OR (US); Eric T Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/335,190

(22) PCT Filed: Jan. 19, 2017

(86) PCT No.: PCT/US2017/014165
§ 371 (c)(1),
(2) Date: Mar. 20, 2019

(87) PCT Pub. No.: WO2018/136074
PCT Pub. Date: Jul. 26, 2018

(65) Prior Publication Data

US 2019/0344562 A1 Nov. 14, 2019

(51) Int. Cl.
*B41J 2/045* (2006.01)

(52) U.S. Cl.
CPC ..... *B41J 2/04543* (2013.01); *B41J 2/0458* (2013.01); *B41J 2/04581* (2013.01)

(58) Field of Classification Search
CPC ... B41J 2/04543; B41J 2/0458; B41J 2/04581
See application file for complete search history.

(56) References Cited

U.S. PATENT DOCUMENTS

| | | | | |
|---|---|---|---|---|
| 4,846,057 | A | 7/1989 | Endo | |
| 6,471,320 | B2 | 9/2002 | Anderson et al. | |
| 6,478,396 | B1 | 11/2002 | Schloeman et al. | |
| 6,564,310 | B2 | 5/2003 | Nakata et al. | |
| 6,729,707 | B2 * | 5/2004 | Corrigan | B41J 2/04506 347/12 |
| 7,163,345 | B2 | 1/2007 | Walmsley et al. | |
| 7,237,485 | B2 | 7/2007 | Meier | |
| 9,533,495 | B2 | 1/2017 | Mogami | |

(Continued)

FOREIGN PATENT DOCUMENTS

| | | |
|---|---|---|
| EP | 0310217 | 4/1989 |
| JP | H6125524 | 5/1994 |
| JP | 2007168144 | 7/2007 |

OTHER PUBLICATIONS

Rice,. H.W. et al, Next-generation Inkjet Printhead Drive Electronics, Jun. 1997, < http://www.hpl.hp.com/hpjourna1/97jun/jun97a5.pdf >.

*Primary Examiner* — Thinh H Nguyen
(74) *Attorney, Agent, or Firm* — Rathe Lindenbaum LLP

(57) ABSTRACT

A fluid ejection device may include a substrate, a first group of fluid drivers on the substrate, a second group of fluid drivers on the substrate, a memory element storing a predetermined offset value and electronics to receive an address of one of the fluid drivers of the first group for actuation control. The electronics may select one of the fluid drivers of the second group for actuation control based on the address and the stored offset value.

20 Claims, 8 Drawing Sheets

(56) References Cited

U.S. PATENT DOCUMENTS

| | | | |
|---|---|---|---|
| 9,537,119 | B2 | 1/2017 | Harjee et al. |
| 2008/0286442 | A1 | 11/2008 | Ushiyama et al. |
| 2010/0328391 | A1 | 12/2010 | Martin et al. |
| 2012/6311219 | | 10/2016 | Nahid et al. |

* cited by examiner

1000

POSEIDON FIRE PULSE GROUP
DATA 0
SLOTS A & B

| MCLK CYCLE # | DATA 0 | | | | |
|---|---|---|---|---|---|
| | RISE | | FALL | | |
| 1 | START ("1") | | PARITY_HEADER | | |
| 2 | START ("0") | | PARITY_DATA | | |
| 3 | START ("1") | | WARM_CTRL | | |
| 4 | FP_SEL_A | | FP_SEL_B | | |
| 5 | ADDR_AL[3] | | ADDR_BL[3] | | |
| 6 | ADDR_AL[2] | | ADDR_BL[2] | | |
| 7 | ADDR_AL[1] | | ADDR_BL[1] | | |
| 8 | ADDR_AL[0] | | ADDR_BL[0] | | |
| 9 | A | 2 | A | 1 | |
| 10 | B | 2 | B | 1 | |
| 11 | A | 4 | A | 3 | |
| 12 | B | 4 | B | 3 | |
| 13 | A | 6 | A | 5 | |
| 14 | B | 6 | B | 5 | |

1002

POSEIDON FIRE PULSE GROUP
DATA 1
SLOTS C & D

| MCLK CYCLE # | DATA 1 | | | | |
|---|---|---|---|---|---|
| | RISE | | FALL | | |
| 1 | X | | DEC[2] | | |
| 2 | X | | DEC[1] | | |
| 3 | X | | DEC[0] | | |
| 4 | FP_SEL_C | | FP_SEL_D | | |
| 5 | ADDR_CL[3] | | ADDR_DL[3] | | |
| 6 | ADDR_CL[2] | | ADDR_DL[2] | | |
| 7 | ADDR_CL[1] | | ADDR_DL[1] | | |
| 8 | ADDR_CL[0] | | ADDR_DL[0] | | |
| 9 | C | 2 | C | 1 | |
| 10 | D | 2 | D | 1 | |
| 11 | C | 4 | C | 3 | |
| 12 | D | 4 | D | 3 | |
| 13 | C | 6 | C | 5 | |
| 14 | D | 6 | D | 5 | |

FIG. 8

FLUID DRIVER ACTUATION CONTROL USING OFFSET

BACKGROUND

Fluid ejection devices may include groups of fluid drivers utilized as part of as fluid ejectors and serving as fluid pumps. Fluid ejection controllers supply the fluid ejection devices with instructions, such as fire pulse groups, for firing the fluid drivers.

BRIEF DESCRIPTION OF THE DRAWINGS

FIG. 8 is a diagram of example data headers for data packets for enabling the actuation of fluid driver addresses of different fluid driver groups.

Figure 1:
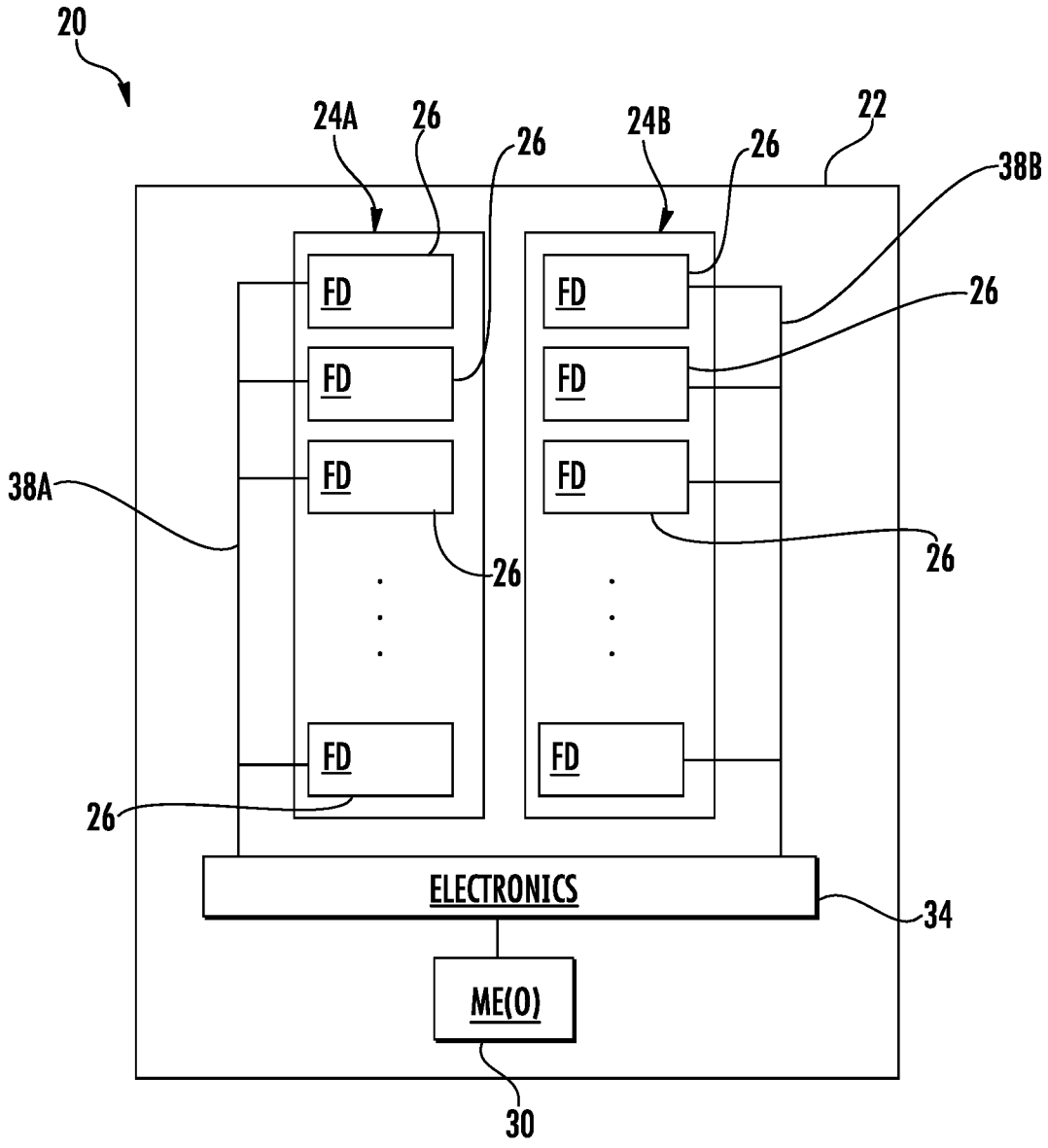
FIG. 1 is a schematic diagram of an example fluid ejection device.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION OF EXAMPLES

Fluid ejection controllers transmit signals to fluid ejection devices controlling which fluid driver addresses are to be actuated or fired by the fluid ejection device. The fluid drivers may be grouped into primitives of multiple fluid drivers, each primitive having the same set of fluid driver addresses. The primitives themselves may be arranged in different sets of primitives or primitive groupings, wherein each different set or primitive grouping is enabled for firing using different dedicated control signal lines. Such fluid ejection controllers may provide such instructions one primitive grouping at a time. For example, each data packet may include a header portion indicating a particular fluid driver address for each of the primitives of a single primitive grouping and a data portion indicating what individual primitives of the primitive grouping are to be fired at the indicated fluid driver address during a fire pulse. Transmitting instructions one fluid driver group address or grouping of primitives (fire pulse group data packets) at a time may utilize multiple data packets to cycle through all addresses and may consume valuable transmission bandwidth.

Disclosed herein are examples of a fluid ejection device, a fluid ejection system and a method that may reduce the amount of data, the number of data packets and/or transmission bandwidth consumed during the provision of fluid ejection instructions to a fluid ejection device. Disclosed herein are examples of a fluid ejection device, a fluid ejection system and a method that may decrease fluid ejection time or increase the rate at which fluid drivers may be fired. In such implementations, a fluid ejection device enables the firing of a fluid driver address of not one, but of two different primitive groupings based upon instructions upon a single received fluid driver address. In such examples, the example fluid ejection device, fluid ejection system and method utilize an offset value stored on the fluid ejection device, wherein the fluid ejection device uses the fluid driver address received by the fluid ejection device to enable the fluid driver address of a first primitive grouping and uses a combination of the fluid driver address received by the fluid ejection device and the stored offset to enable a different fluid driver address of a different fluid driver group or group of primitives.

Disclosed herein is an example fluid ejection device which comprises a substrate, a first group of fluid drivers on the substrate, a second group of fluid drivers on the substrate, and a memory element storing a predetermined offset value and electronics. The electronics may receive an address of one of the fluid drivers of the first group for actuation control and to select one of the fluid drivers of the second group for actuation control based on the address and the stored offset value.

Disclosed herein is an example fluid ejection system which may comprise a fluid ejection controller for use with a fluid ejection device having a first group of fluid drivers and a second group of fluid drivers on a second side of the fluid feed slot. The fluid ejection controller may transmit an address of one of the fluid drivers of the first group for actuation control and may further transmit an offset value to the fluid ejection device for use by the fluid ejection device in selecting one of the fluid drivers of the second group for actuation control based on the address and the transmitted offset value.

Disclosed herein is an example method which may comprise receiving, with a fluid ejection device, a first address of a fluid driver of a first group of fluid drivers on a substrate for actuation and determining, on the fluid ejection device, a second address of a fluid driver of a second group of fluid drivers on the substrate for actuation control based upon the first address and an offset value.

FIG. 1 schematically illustrates an example fluid ejection device 20 that may reduce the amount of data, the number of data packets and/or transmission bandwidth consumed during the provision of fluid ejection instructions to a fluid ejection device. Fluid ejection device 20 may further decrease fluid ejection time or increase the rate at its fluid drivers may be fired. Fluid ejection device 20 may facilitate the generation of fluid driver enablement or actuation signals for two different groupings of fluid drivers using a single received fluid driver address and a stored offset value.

The example fluid ejection device 20 comprises substrate 22, a first group 24A of fluid drivers 26, a second group 24B of fluid drivers 26, memory element (ME) 30 and electronics 34. Substrate 22 comprises a base or foundation for fluid drivers 26 and those supplies that supply fluid to fluid drivers 26. In one implementation, substrate 22 may be formed from silicon. In other implementations, substrate 22 may be formed from other materials such as polymers or ceramics. In one implementation, substrate 22 may be part of a fluid ejection die upon which electronic components and circuitry are fabricated.

Groups 24A and 24B (collectively referred to as groups 24) of fluid drivers 26 each comprise a plurality of fluid drivers 26 that receive actuation or enablement signals from electronics 34 across a same actuation signal line. In the example illustrated, each of fluid drivers 26 of group 24A receive actuation or enablement signals from electronics 34 across actuation signal line 38A. Likewise, each of fluid drivers 26 of group 24B receive actuation or enablement signals from electronics 34 across signal line 38B. Each of signal lines 38 may be connected to logic elements, such as transistors, that facilitate the enablement of a selected individual fluid driver 26 of each of group.

In one implementation, groups 24 of fluid drivers 26 may comprise primitive groupings, wherein each of groups 24 comprises a plurality of primitives and wherein each of the primitives comprises a set or group of fluid drivers, including fluid drivers of fluid ejectors. In some implementations, the set or group of fluid drivers in each of the primitives additionally comprises fluid drivers that serve as pumps for the fluid ejectors. In one implementation, each of the groups 24 of fluid drivers are arranged in a column of fluid drivers. For example, the drivers of group 24A may be arranged in a first column while the drivers of group 24B are arranged in a second column parallel to the first column. In one implementation, the two columns may be located adjacent to and on opposite sides of a fluid feed slot. In one implementation, the two columns may be located along different fluid feed slots. In other implementations, the groups may be formed from different fluid drivers along columns of individual fluid feed passages or holes, wherein each fluid feed whole supplies fluid to an individual fluid ejector and its associated fluid driver or multiple fluid ejectors, such as pairs of fluid ejectors, that share an associated pump. In yet other implementations, the groups 24 of fluid drivers may each comprise other arrangements or arrays of fluid drivers.

Each of fluid drivers 26 comprises an element that drives or moves fluid. Some of fluid drivers 26 in each of groups 24 may be associated with a firing chamber and nozzle, wherein such fluid drivers are part of a fluid ejector by serving to drive fluid within the firing chamber through the nozzle. In some implementations, some of the fluid drivers 26 in each of groups 24 may serve as pumps for ejectors, driving fluid into the firing chamber of the ejector, thereby mixing fluid and maintaining fresh fluid in the firing chamber of an associated ejector. In other implementations, the ejectors may omit such additional fluid pumps.

In one implementation, each of fluid drivers 26 comprises a thermally resistive element adjacent a volume, wherein the thermally resistive element, upon receiving electrical current, generates a sufficient amount of heat to vaporize fluid so as to create a bubble, wherein the bubble drives fluid from the volume. For example, where the fluid driver is part of a fluid ejector, the volume is the firing chamber adjacent the nozzle such that the bubble drives fluid through the nozzle to eject the fluid. Where the fluid driver is part of a fluid pump, the volume is connected to the firing chamber to form an inertial pump such that the bubble drives fluid into the firing chamber to mix fluid within and circulate fluid across the firing chamber.

In other implementations, each of fluid drivers 26 may comprise a flexible membrane that is moved to reduce the size of the adjacent volume so as to force fluid out of the adjacent volume, either through a nozzle as in the case of an ejector, or into a firing chamber, as in the case of a pump. For example, in one implementation, each of fluid drivers 26 may comprise a piezo-resistive element that changes shape or size in response to being heated or in response to electrical current. In yet other implementations, fluid driver 36 may comprise other devices or elements that may be selectively controlled to expel fluid within and from an adjacent volume, either through a nozzle or into the firing chamber that extends adjacent a nozzle and another fluid driver.

Memory element 30 comprises an element formed upon and supported by substrate 22 that stores an offset value O. In one implementation, memory element 30 comprises a non-transitory computer-readable medium or a circuit element, such as a flip-flop or latch circuit element, that stores the offset value O. In one implementation, memory element 30 comprises a nonvolatile memory by which data representing the value of an offset O is permanently written and is not erased when the fluid ejection system employing fluid ejection device 20 is powered off. Because the offset value O may be stored by memory element 30 directly on fluid ejection device 20, the offset value may be transmitted to fluid ejection device 20 and stored in memory element 30 during setup, initialization, at predetermined periodic intervals or during manufacturing. In one implementation, memory element 30 may comprise a volatile memory, such as a random access memory, wherein memory element 30 receives the value for offset O at the beginning of each power up of the system employing fluid ejection device 20.

The offset O stored by memory element 30 comprises a value which predicates a spacing between the fluid driver address received for a firing moment for one of groups 24 and the fluid driver address to be fired during the same or closely spaced firing moment for the other of groups 24. In one implementation, offset O represents a spacing that reduces or eliminates interference that might otherwise result if the addresses of the two different fluid driver groups are too close to one another. For example, fluid driver 20 may receive a first fluid driver address of the first group 24A designated for firing, wherein the offset O predicates a minimum distance or spacing between received first fluid driver address and a second fluid driver address to be fired for the second group 24B. In one implementation, the offset O may be in terms of a number of fluid drivers or a number of fluid driver addresses.

Electronics 34 comprises electronic circuitry and/or a processing unit and associated software or programs instructions stored on a non-transitory computerize readable medium that participate in the control of the actuation of the fluid drivers 26 of the groups 24 on fluid ejection device 20. In one implementation, electronics 34 comprise circuitry integrated into and formed upon substrate 22. In another implementation, electronics 34 comprise circuitry mounted to substrate 22. In some implementations, electronics 34 may be provided on a structure separate from substrate 22, wherein the electronics receive address data from a separate fluid ejection controller and provide enablement or actuation signals and fire pulses for the fluid drivers on substrate 22. Electronics 34 carry out method 100 described with respect to FIG. 2.

Figure 2:
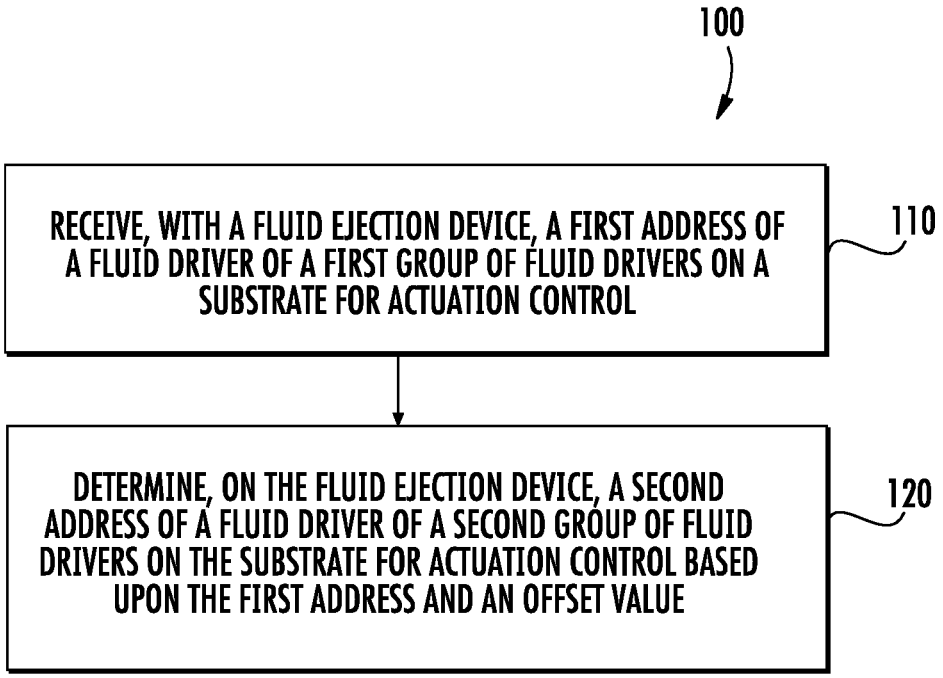
FIG. 2 is a flow diagram of an example method for controlling the actuation of fluid drivers on a fluid ejection device.

FIG. 2 is a flow diagram of an example method 100 for selecting and controlling what fluid drivers on a fluid ejection device are to be fired or actuated. Method 100 may reduce the amount of data, the number of data packets and/or transmission bandwidth consumed during the provision of fluid ejection instructions to a fluid ejection device. Method 100 may further decrease fluid ejection time or increase the rate at its fluid drivers may be fired. Method 100 may facilitate the generation of fluid driver enablement or actuation signals for two different groupings of fluid drivers based upon a single received fluid driver address for one of the groupings and based upon the received fluid driver address in combination with a stored offset value for the other of the groupings. Although method 100 is described as being carried out using fluid ejection device 20, it should be appreciated that method 100 may be carried out by any of the fluid ejection devices and fluid ejection systems described hereafter or other similar fluid ejection devices or systems.

As indicated by block 110 of FIG. 2, electronics 34 of fluid ejection device 20 receives a first address a fluid driver 26 of a first group 24A, 24B of fluid drivers 26 on substrate 22. The first address is received in a wired or wireless fashion from a remote fluid ejection controller. In one implementation, the remote fluid ejection controller is not on substrate 22. In one implementation, fluid ejection device 20 comprises the print die of a print head, wherein the address is received from a fluid ejection controller remote from the print die and the print head.

As indicated by block 120, electronics 34 on fluid ejection device 20 determines a second address of a fluid driver 26 of a second group 24A, 24B of fluid drivers 26 on substrate 22 for actuation control based upon the first address received in block 110 and the offset value O stored in memory element 30. In one implementation, electronics 34 determines which fluid driver address to actuate in the second group of fluid drivers 26 by adding a predetermined number of fluid drivers (represented by the offset O) to the received of the fluid driver to be actuated in the first group of fluid drivers. For example, in one implementation, groups 24A and 24B may have the same sequence of fluid drivers. In such an implementation, should electronics 34 receive address 4 in the first group 24A of fluid drivers 26, and should offset O have a value of three fluid drivers, electronics 34 would determine that the fluid driver of address 7 (received address of 4+ offset value of 3) in the second group 24B of fluid drivers should be fired at the same time or substantially the same time as the firing of address 4 in the first group 24A of fluid drivers 26 on the example substrate 22.

Although the above example illustrates the determination of the fluid driver 26 to be fired in the second group by adding the offset value to the received address, it should be appreciated the offset may be used to determine what fluid driver address is to be fired in the other group in other fashions. For example, the fluid driver address to be fired in the second group of fluid drivers may also be determined by subtracting the offset value from the received fluid driver address for the first group of fluid drivers. The fluid driver address to be fired in the second group of fluid drivers may be determined by multiplying or dividing the received fluid driver address for the first group of fluid drivers by an offset value, and then rounding up or down. As should be appreciated, the fluid driver address to be fired in the second group of fluid drivers may be based upon a variety of different formulas which utilize the received fluid driver address for the first group of fluid drivers and some offset value stored by memory element 30.

Figure 3:
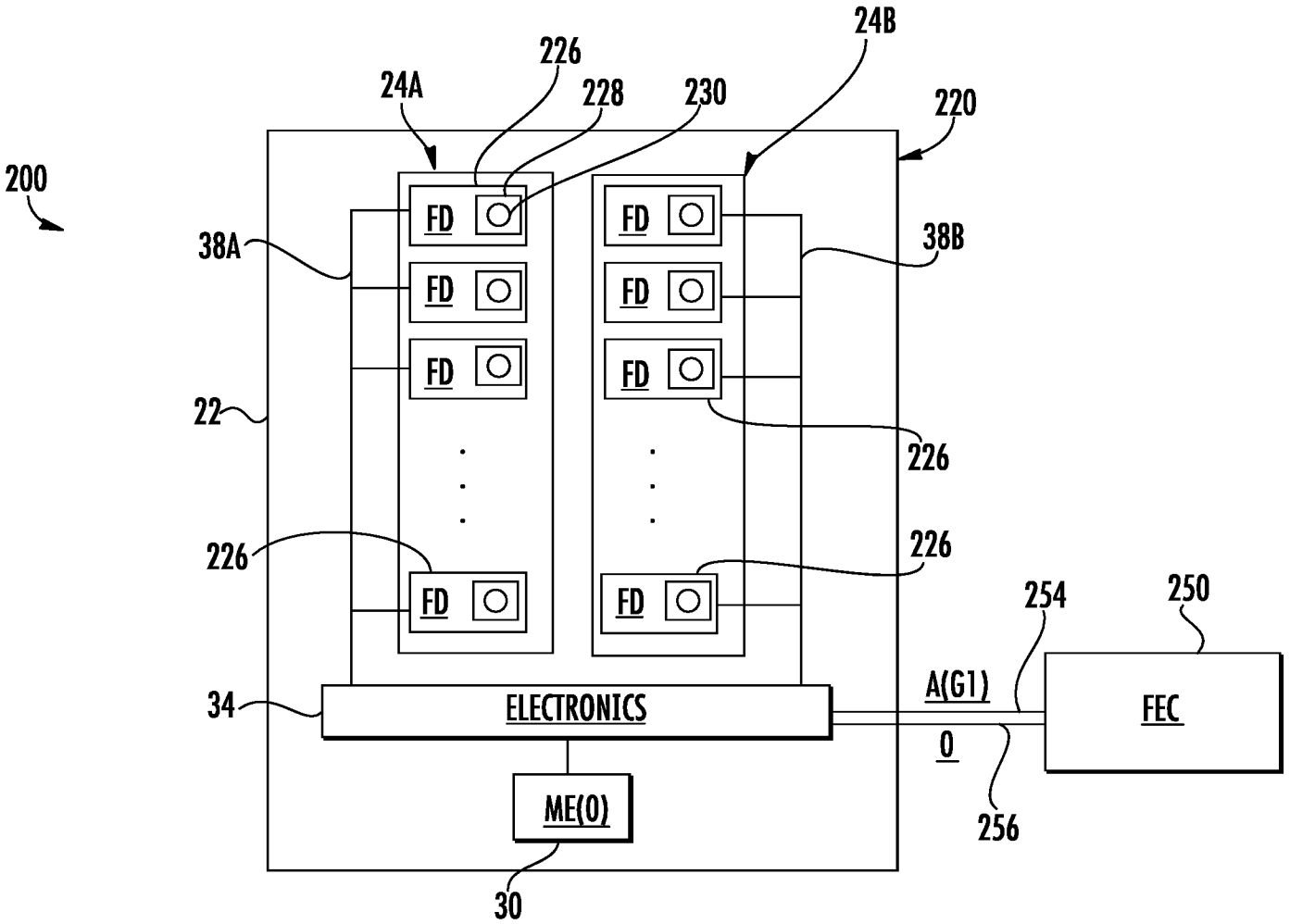
FIG. 3 is a schematic diagram of an example fluid ejection system.

FIG. 3 schematically illustrates an example fluid ejection system 200 for controlling the ejection of fluid. Fluid ejection system 200 may reduce the amount of data, the number of data packets and/or transmission bandwidth consumed during the provision of fluid ejection instructions to a fluid ejection device. Fluid ejection system may further decrease fluid ejection time or increase the rate at which its fluid drivers may be fired. Fluid ejection system 200 may facilitate the generation of fluid driver enablement or actuation signals for two different groupings of fluid drivers based upon a single fluid driver address received by a fluid ejection device for one of the groupings and based upon the received fluid driver address in combination with a stored offset value for the other of the groupings. Fluid ejection system 200 comprises fluid ejection device 220 and fluid ejection controller (FEC) 250.

Fluid ejection device 220 is similar to fluid ejection device 20 described above except that fluid ejection device 220 is specifically illustrated as comprising fluid drivers 226 which are each associated with a firing chamber 228 and a nozzle 230 to form a fluid ejector. In the example illustrated, fluid ejection device 220 omits pumps associated with the individual fluid ejectors to mix fluid. Those remaining components of fluid ejection device 220 which correspond to components of fluid ejection device 20 are numbered similarly.

Fluid ejection controller 250 comprises electronics, such as a processing unit and an associated non-transitory computer-readable medium that provides a structure for directing the processing unit. Fluid ejection controller 250 is remote from electronics 34 and fluid ejection device 220. Fluid ejection controller 250 transmits image data to electronics 34 of fluid ejection device 220 (as well as other fluid ejection devices 220) in a wired or wireless fashion. In one implementation, fluid ejection controller 250 is part of a self-contained ejection system, wherein fluid ejection controller 250 and fluid ejection device 200 are part of a self-contained unit within a single housing.

As shown by FIG. 3, fluid ejection controller 250 transmits a fluid driver address A for a first group of fluid drivers G1. In the example illustrated, fluid ejection controller 250 further transmits the offset O. In the example illustrated, fluid ejection controller 250 transmits the offset O less frequently or a fewer number of times as compared to the number of times that fluid ejection controller 250 transmits the address of the fluid driver to be fired during each of the firing moments or with generated fire pulses. In one implementation, fluid ejection controller 250 transmits the offset O to fluid ejection device 220 once upon initialization of fluid ejection system 200, wherein the offset is stored in a non-volatile memory element 30 on fluid ejection device 220. In another implementation, fluid ejection controller 250 transmits the offset O to fluid ejection device 220 during the power up of system 200, wherein the memory offset O is stored in a volatile memory element 30 on fluid ejection device 220. In yet other implementations, fluid ejection controller 250 transmits the offset O to fluid ejection device 220 at other predetermined times or other predetermined periodic intervals having a frequency less than the frequency at which fluid ejection controller 250 transmits a fluid driver addresses to fluid ejection device 220 for the first group of fluid drivers on fluid ejection device 220.

In one implementation, fluid ejection controller 250 transmits the offset O and transmits the address of the fluid driver to be fired for the first group of fluid drivers using separate transmission lines. In the example illustrated, fluid ejection controller 250 transmits the fluid driver address for the first group of fluid drivers using a first transmission line 254 and transmits the offset O using a separate and distinct transmission line 256. As a result, the transmission of the offset O does not interfere with the transmission of the fluid driver addresses.

In one implementation, fluid ejection device 220 comprises a print die of a print head, wherein fluid ejection controller 250 comprises a print controller. In such an implementation, device 220 and controller 250 are part of a single contained housing or unit forming a printer. In one implementation, the different groups 24 of fluid drivers 26 eject different types of ink, such as different colors of ink.

Figure 4:
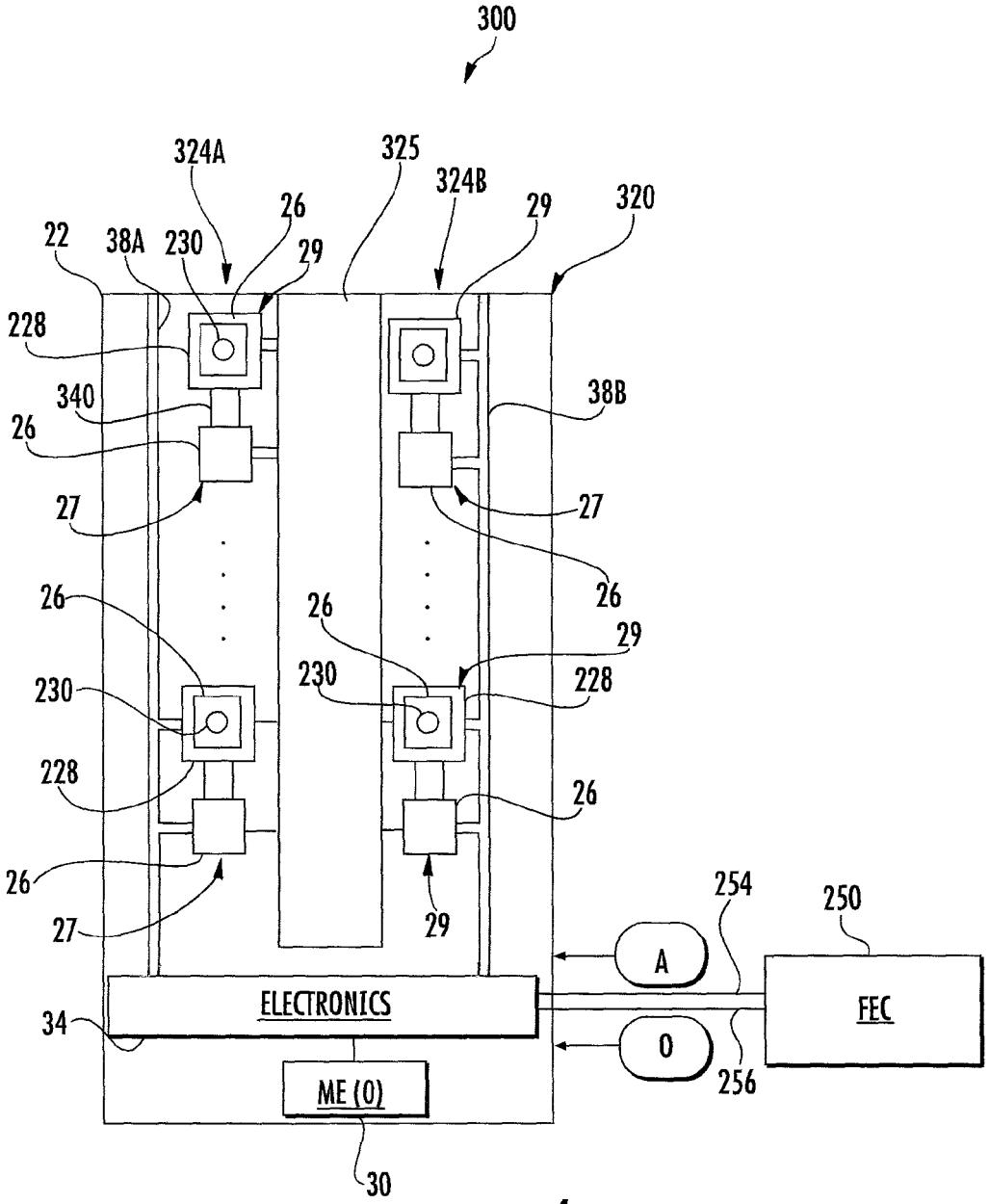
FIG. 4 is a schematic diagram of another example fluid ejection system.

FIG. 4 schematically illustrates fluid ejection system 300, another example implementation of fluid ejection system 200. Fluid ejection system 300 is similar to fluid ejection system 200 except that fluid ejection system 300 comprises fluid ejection device 320 in place of fluid ejection device 220. Those remaining components of fluid ejection system 300 which correspond to components of fluid ejection system 200 are numbered similarly.

Fluid ejection device 320 is itself similar to fluid ejection device 220 except that fluid ejection device 320 comprises groups 324A and 324B (collectively referred to as group 324) of fluid drivers 26 specifically illustrated as being arranged along, receiving fluid from and circulating fluid to an intermediate fluid feed slot 325. Groups 324 each comprise a column of fluid drivers 26 on opposite sides of slot 325. Each of groups 324 comprises a column of associated fluid drivers or pairs of fluid drivers 26, each pair comprising a first fluid driver 26 serving as a pump 27 and a second fluid driver 26 adjacent to a firing chamber 228 and a nozzle 230 so as to form a fluid ejector 29. The first fluid driver 26 of each pair draws fluid from slot 325 and, upon being fired, drives fluid through passage 340 into the associated firing chamber 228. Serving as a pump 27, the first fluid driver may be used to maintain mixed or fresh fluid within the associated firing chamber 228. The second fluid driver 26 of each pair, upon being fired, drives fluid within the firing chamber 228 through nozzle 230. Fluid not ejected through nozzle 230 is recirculated back into fluid feed slot 325.

Slot 325 receives fluid from a fluid supply source, such as a volume of a fluid cartridge secured to and moving with fluid ejection substrate 22 of device 320 or remote from substrate 22 of fluid ejection device 320, such as with an off-axis fluid supply. Slot 325 supplies fluid to the pump formed by the first fluid driver 26. Slot 325 further receives fluid from firing chamber 228 that is not ejected through nozzle 230. As with fluid ejection device 220, fluid ejection device 320 comprises electronics 34 that carry out method 100 described above.

Figure 5:
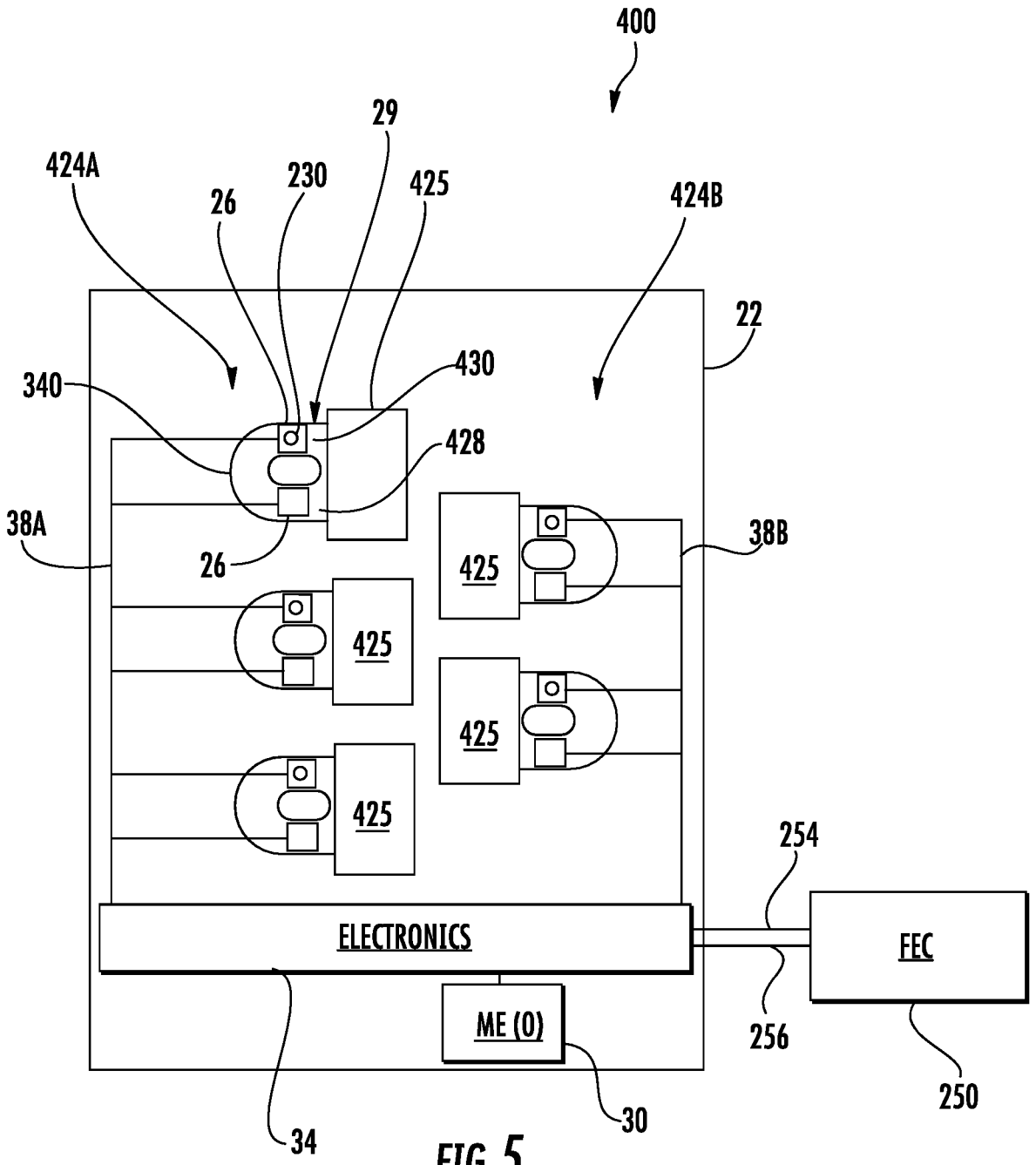
FIG. 5 is a schematic diagram of another example fluid ejection system.

FIG. 5 schematically illustrates fluid ejection system 400, another example implementation of fluid ejection system 200 described above. Fluid ejection system 400 is similar to fluid ejection system 300 except that fluid ejection system 400 is specifically illustrated as having fluid feed holes 425 in place of slot 325, wherein each of the holes 425 supplies fluid to the first fluid driver 26 serving as a fluid pump 27 and receives fluid from the fluid ejector 29 formed by the second fluid driver 26. Each fluid pump 27 is connected to the feed hole 425 by an inlet passage 428. Each firing chamber 228 of each fluid ejector 29 is connected to the feed hole 425 by an outlet passage 430. Passages 428 and 430 facilitate circulation of fluid from the feed hole 742, into the bottom adjacent pump 27, through passage 340, into the firing chamber 228 and back into the feed hole 425 through passage 430. Each feed hole 742 is supplied with fluid from a fluid source (not shown) such as a fluid containing volume of a fluid cartridge to which fluid ejection device 420 is formed or mounted or from a fluid source that is remote with respect to fluid ejection device 420.

In the example illustrated, drivers 26 are grouped so as to form a first group 424A of fluid drivers in a first column and a second group 424B of fluid drivers and a second column. The fluid drivers of group 424A receive enablement or actuation signals from line 38A while the fluid drivers of group 424B received enablement or actuation signals from line 38B. Although the two different groups 424 are illustrated as comprising two linear columns of fluid drivers, in other implementations, the fluid drivers groups may have other shapes or arrangements, wherein each of the fluid drivers of an individual group receive enablement or actuation signals from a same signal transmission line. As with fluid ejection device 220, fluid ejection device 420 comprises electronics 34 that carry out method 100 described above.

Figure 6:
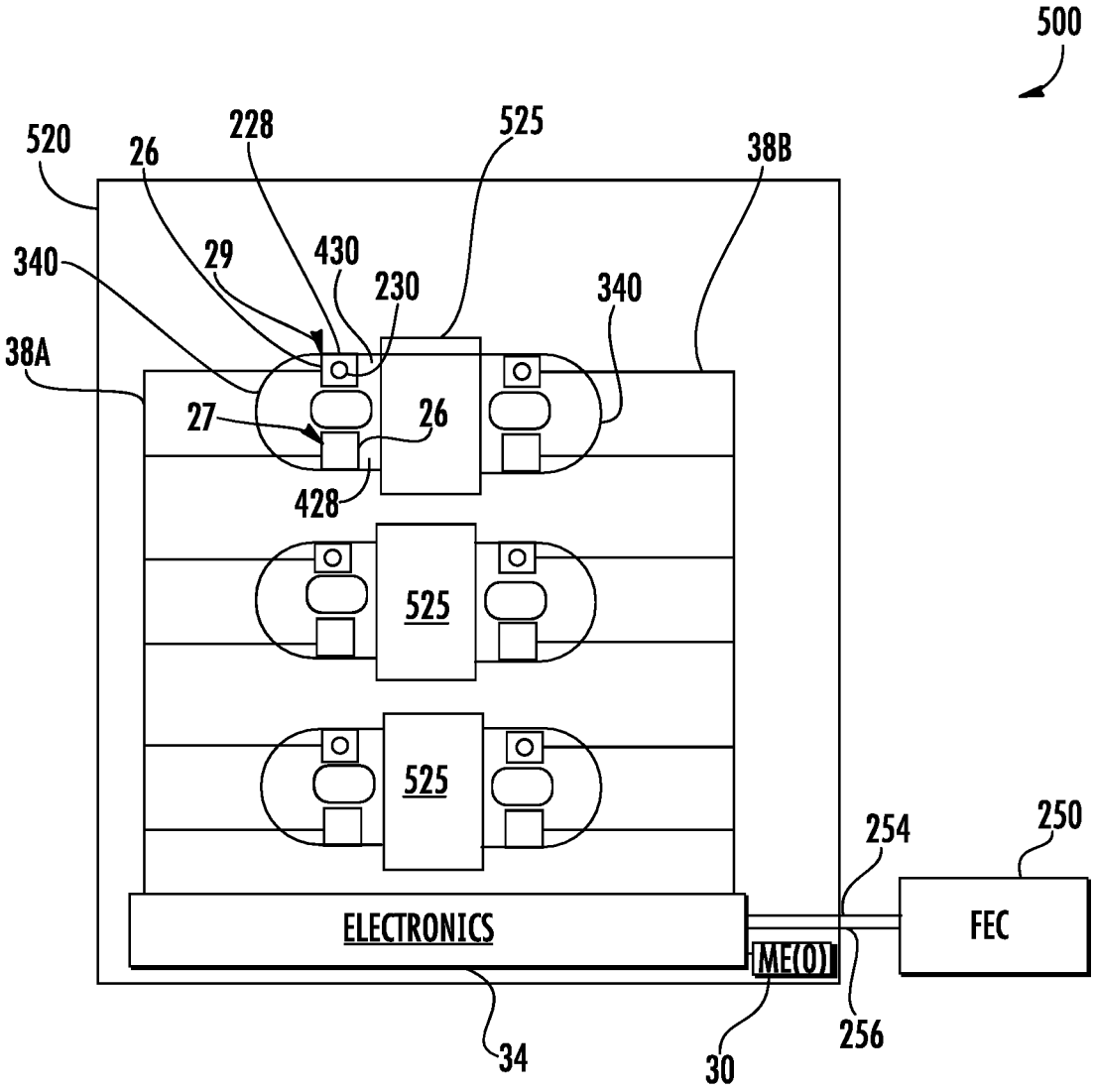
FIG. 6 is a schematic diagram of another example fluid ejection system.

FIG. 6 schematically illustrates fluid ejection system 500. Fluid ejection system 500 is similar to fluid ejection system 400 except that fluid ejection system 500 is specifically illustrated as comprising fluid ejection device 520 comprising fluid feed holes 525 in place of feed holes 425. Each of the fluid feed holes 525 supplies fluid to a pair of fluid drivers 26 of a pair of fluid pumps 27 and receives fluid from a pair of fluid drivers 26 of a pair of fluid ejectors 29. Each fluid pump 27 is connected to an associated feed hole 525 by an inlet passage 428. Each fluid ejector 29 is connected to the associated fluid feed hole 525 by an outlet passage 430, wherein passages 428 and 430 facilitate circulation of fluid from the hole 525, into the pump 27, through passage 340, into the firing chamber 228 and back into the hole 525 through passage 430. Each hole 525 is supplied with fluid from a fluid source (not shown) such as a fluid containing volume of a fluid cartridge to which fluid ejection device 520 is formed or mounted or from a fluid source that is remote with respect to fluid ejection device 520.

In the example illustrated, drivers 26 are grouped so as to form a first group 524A of fluid drivers in a first column and a second group 524B of fluid drivers and a second column. The fluid drivers of group 524A receive enablement or actuation signals from line 38A while the fluid drivers of group 524B received enablement or actuation signals from line 38B. Although the two different groups 524 are illustrated as comprising two linear columns of fluid drivers, in other implementations, the fluid drivers may be part of fluid driver groups having other shapes or arrangements, wherein each of the fluid drivers of an individual group receive enablement or actuation signals from a same signal transmission line. As with fluid ejection device 220, fluid ejection device 520 comprises electronics 34 that carry out method 100 described above.

Figure 7:
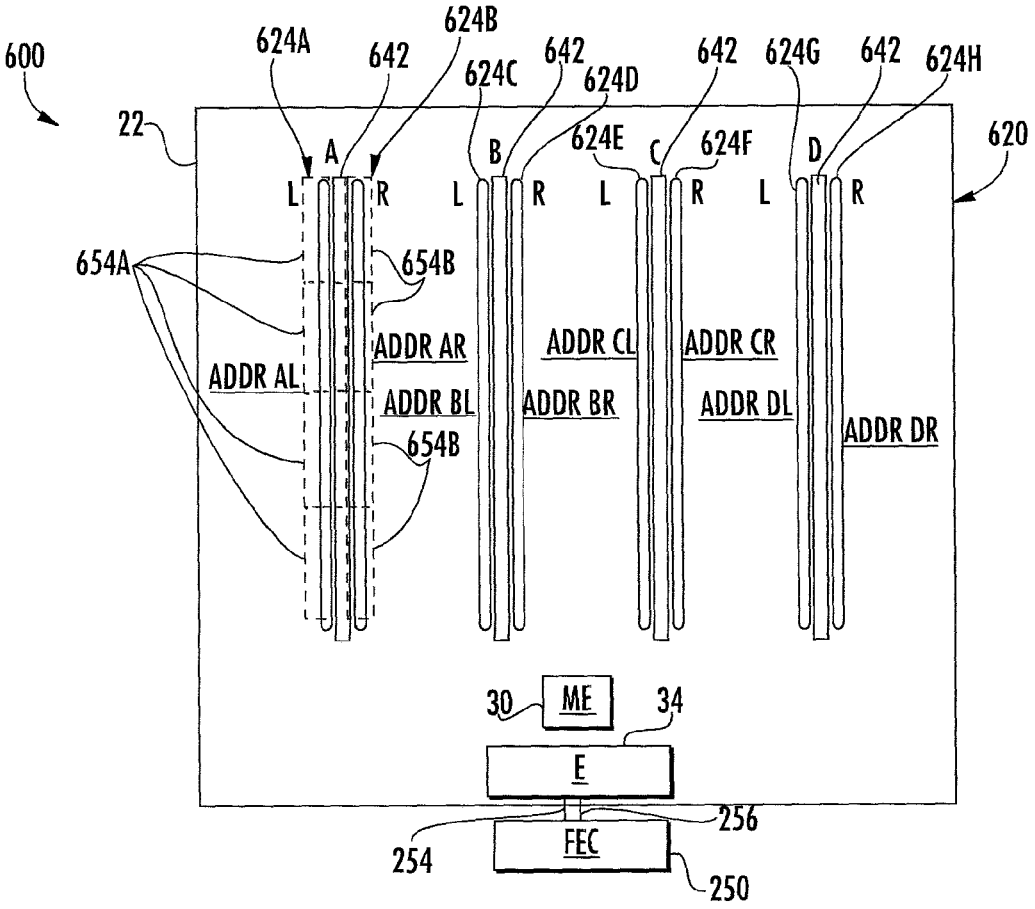
FIG. 7 is a schematic diagram of another example fluid ejection system.

FIG. 7 schematically illustrates fluid ejection system 600, another example implementation of fluid ejection system 300. Fluid ejection system 600 is similar to fluid ejection system 300 described above except that fluid ejection system 600 is illustrated as comprising a fluid ejection device 620 comprising multiple fluid ejection slots 642 (slot A, slot B, slot C and slot D) formed in substrate 22 through which fluid is supplied to columns of fluid drivers 26 on the opposite sides (the left side L and the right side R) of each of slots 642. The fluid drivers 26 extending along each side of each slot 642 receive enablement or actuation signals along a same transmission line such that the fluid drivers extend along each side of each of slots 642 forms an individual group of fluid drivers. For example, the fluid drivers 26 on the left side L of slot A form a first group 624A of fluid drivers 26 receiving enablement or actuation singles by a first transmission line while the fluid drivers 26 on the right side R of slot A form a second group 624B of fluid drivers 26 receiving enablement or actuation singles by a second different transmission line. The fluid drivers 26 on the left side L of slot B form a third group 624C of fluid drivers 26 receiving enablement or actuation signals by a third transmission line while the fluid drivers 26 on the right side R of slot B form a fourth group 624D of fluid drivers 26 receiving enablement or actuation signals by fourth transmission line, and so on with respect to the remaining slots (fluid driver groups 624E, 624F, 624G and 624H).

In one implementation, each of groups 624 of fluid drivers 26 comprises a series or column of fluid drivers 26 similar to group 24A or group 24B of fluid ejection device 220, wherein each of the fluid drivers is part of a fluid ejector without a corresponding associated fluid pump. In yet another implementation, each of group 624 of fluid drivers 26 comprise a series or column of fluid drivers 26 similar to group 324A or 324B of fluid ejection device 320 described above, wherein the fluid drivers form both fluid pumps 27 and associated fluid ejectors 29. In some implementations, rather than driving fluid into and through a single associated firing chamber 228 of a single associated fluid ejector 29, the fluid pumps 27 of each of group 624 may drive fluid into and through a plurality of firing chambers 228 of a plurality of associated fluid ejectors 29 connected to the individual fluid pump 27 alongside the respective slot 642.

As schematically illustrated by broken lines in FIG. 7 with respect to slot A, the fluid drivers 26 on the left side of slots 642 and forming the first group 624A of fluid drivers 26 are subdivided into a plurality of primitives 654A. Likewise, the fluid drivers 26 on the right side of slot A and forming the second group 624B of fluid drivers 26 are subdivided into a plurality of primitives 654B. In the example illustrated, each of the individual remaining fluid driver groups 624 are also subdivided into a plurality of primitives. Each primitive may have the same set of fluid driver addresses. For example, in one implementation, each primitive 654 of fluid driver group 624A may have fluid driver addresses 1-16, a first 8 fluid drivers forming fluid ejectors and a second 8 fluid drivers, alternating with the first eight fluid drivers, that form fluid pumps for the fluid ejectors.

Fluid ejection system 600 operates in a fashion similar to the operation of fluid ejection systems 200, 300, 400 and 500 described above, carrying out method 100. As schematically shown by FIG. 7, fluid ejection device 620 includes include the memory element 30 that stores an offset O. Fluid ejection controller 250 transmits an address for the primitive grouping or fluid driver group 624A to the electronics 34 on fluid ejection device 620. Based upon the received address and the stored offset O, electronics 34 determines the address for the primitive grouping or fluid driver group 624B. Electronics 34 utilizes the received address for the fluid driver group 624A to actuate the fluid drivers 26 of each of the primitives 654 of group 624A, enabling such fluid drivers to receive the fire pulse during a fire pulse transmission. Electronics 34 further utilizes the address determined from the received address and the offset to actuate the fluid drivers 26 of each of the primitives 654 of group 624B. Electronics 34 enable or actuate fluid drivers of each of the primitives 654 having a first address in fluid driver group 624A and a second different address in fluid driver group 624B using a single transmitted or received address from fluid ejection controller 250. The same process may be repeated for the fluid driver group 624 of each of the other slots B, C and D on the fluid ejection device 620 under the control of electronics 34. As a result, fluid ejection system 600 may reduce the amount of data, the number of data packets and/or transmission bandwidth consumed during the provision of fluid ejection instructions to a fluid ejection device. Fluid ejection system 600 may further decrease fluid ejection time or increase the rate at its fluid drivers may be fired.

In some implementations, the address received for the fluid driver of one of fluid driver group, such as fluid driver group 624A, may be utilized to enable or actuate the fluid drivers of multiple other fluid driver groups. For example, the address received for fluid driver group 624A may be used to enable or actuate fluid drivers for fluid driver groups 624A and 624C, wherein the address received for fluid driver group 624A and the offset may be used to enable or actuate fluid drivers for fluid driver groups 624B and 624D. In another implementation, the address received for fluid driver group 624A may be used to enable or actuate fluid drivers for fluid driver groups 624A, 624C, 624E and 624G, wherein the address received for fluid driver group 624A and the offset may be used to enable or actuate fluid drivers for fluid driver groups 624B, 624D, 624F and 624H.

FIG. 8 illustrates example data packets 1000 and 1002 to be transmitted from fluid ejection controller 450 to electronics 150 for the control of the fluid drivers 26 forming the fluid ejectors and pumps on fluid ejection device 620 of system 600. FIG. 8 illustrates the first 14 clock cycles for the transmission of fire pulse group data for slots A and B in data header 1000 for slots C and D in data header 1002. As should be understood, there may be more cycles in a data packet depending upon the number of primitives. Each clock cycle has a rise time and a fall time, during each of which signals on a separate signal transmission line are read. For example, during clock cycle 1, the voltage on a separate signal transmission line is sensed once during the rise of the clock cycle and once during the fall of the clock cycle. The different sensed voltages may correspond to either a zero or a one (binary) and represent information being transmitted. The information contained in the data header is stored by electronics 34 and is used by a fire pulse generator in electronics 34 to generate a fire pulse for the fluid drivers for each fluid driver groups.

In the example illustrated, binary signals (0 or 1) transmitted during clock cycles 5-8, particularly during the rise of each of the clock signals 5-8, indicates a first address of the fluid ejector 26 in each of the primitives 954 of fluid driver group 624A on the left side L of slot A for which the data header applies during a single fire pulse. The binary signals (0 or 1) transmitted during clock cycles 5-8 during the fall of each of the clock signals 5-8, indicates a second address of the fluid ejector 26 in each of the primitives 954 of fluid driver group 624C on the left side L of slot B for which the data header applies during a single fire pulse. Using these two identified addresses, electronics 34 may determine the address of the fluid drivers to be enabled or actuated in fluid driver group groups 624B and 624D. For example, electronics 34 may automatically determine the fluid driver address for fluid driver group 624B using the received address for fluid driver group 624A and, using the received address for fluid driver group 624C, may automatically determine the fluid driver address for fluid driver group 624D. Electronics 34 utilizes header 1002, which is similar to header 1000, in a similar fashion, receiving the fluid driver addresses for fluid driver group 624E and 624G to determine the fluid driver addresses for fluid driver group 624F and 624H based upon the received fluid driver addresses for fluid driver group groups 624E and 624G in combination with the stored offset O.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. An apparatus comprising:

a fluid ejection device comprising:

a substrate;

a first group of fluid drivers on the substrate;

a second group of fluid drivers on the substrate;

a memory element storing a predetermined offset value; and electronics to receive an address of one of the fluid drivers of the first group for actuation control from a fluid ejection controller remote from the fluid ejection device and to select one of the fluid drivers of the second group for actuation control based on the address and the stored offset value.

2. The apparatus of claim 1, wherein the first group of fluid drivers and the second group of fluid drivers each comprise first fluid drivers serving as fluid pumps and second fluid drivers serving as part of fluid ejectors.

3. The apparatus of claim 1, wherein the memory element comprises a volatile memory element on the substrate.

4. The apparatus of claim 1, wherein the memory element comprises a non-volatile memory element on the substrate.

5. The apparatus of claim 1 further comprising the fluid ejection controller to transmit the offset value to the fluid ejection device.

6. The apparatus of claim 5, wherein the fluid ejection controller is to transmit the offset value to the fluid ejection device prior to the transmission of print data to the fluid ejection device.

7. The apparatus of claim 1, wherein said one of the fluid drivers of the first group having the address and said one of the fluid drivers of the second group selected for actuation control based on the address and the stored offset value are to be fired at a same firing moment.

8. The apparatus of claim 1, wherein the first group comprises a first primitive grouping of fluid drivers and wherein the second group comprises a second primitive grouping of fluid drivers.

9. The apparatus of claim 1 further comprising a third group of fluid drivers on the substrate, where the electronics are to further select one of the fluid drivers of the third group for actuation control based on the address and the stored offset value.

10. The apparatus of claim 1, wherein the fluid ejection device comprises a print die of a printhead.

11. A fluid ejection system comprising:

a fluid ejection controller for use with a fluid ejection device having a first group of fluid drivers and a second group of fluid drivers, the fluid ejection controller to:

transmit an address of one of the fluid drivers of the first group for actuation control;

transmit an offset value to the fluid ejection device for use by the fluid ejection device in selecting one of the fluid drivers of the second group for actuation control based on the address and the transmitted offset value.

12. The fluid ejection system of claim 11, wherein the fluid ejection controller is to transmit the address as part of a fire pulse group further comprising firing data for the first group of fluid drivers and the second group of fluid drivers and wherein the fluid ejection controller is to transmit the offset value separately from the transmission of the fire pulse group.

13. The fluid ejection system of claim 12, wherein the fluid ejection controller is to transmit the offset value to the fluid ejection device prior to the transmission of the fire pulse group to the fluid ejection device.

14. The fluid ejection system of claim 11, wherein the fluid ejection controller is to transmit a plurality of fire pulse groups, each of the plurality of fire pulse groups comprising firing data for both the first group of fluid drivers and the second group of fluid drivers and wherein each of the plurality of fire pulse groups further comprises an address of one of the fluid drivers of the first group for actuation control pursuant to the firing data for the first group of fluid drivers while omitting an address of one of the fluid drivers of the second group for actuation control.

15. The fluid ejection system of claim 11 further comprising the fluid ejection device, wherein the fluid ejection device comprises:

a memory element to store the offset value transmitted by the fluid ejection controller; and electronics to receive the address of said one of the fluid drivers of the first group for actuation control and to select said one of the fluid drivers of the second group for actuation control based on the address and the stored offset value.

16. The fluid ejection system of claim 15, wherein the first group of fluid drivers comprises fluid ejectors and fluid pumps and wherein the second group of fluid drivers comprises fluid ejectors and fluid pumps.

17. The fluid ejection system of claim 15, wherein the memory element comprises volatile memory element.

18. A method comprising:

receiving, with a fluid ejection device, a first address of a fluid driver of a first group of fluid drivers on a substrate for actuation control; and determining, on the fluid ejection device, a second address of a fluid driver of a second group of fluid drivers on the substrate for actuation control based upon the first address and an offset value.

19. The method of claim 18 further comprising transmitting a plurality of fire pulse groups to the fluid ejection device, each of the plurality of fire pulse groups comprising firing data for both the first group of fluid drivers and the second group of fluid drivers and wherein each of the plurality of fire pulse groups further comprising an address of one of the fluid drivers of the first group for actuation control pursuant to the firing data for the first group of fluid drivers while omitting an address of one of the fluid drivers of the second group for actuation control.

20. The method of claim 18 further comprising transmitting the first address to the fluid ejection device from a fluid ejection controller remote from the fluid ejection device.

* * * * *